US005222825A

United States Patent [19]

Wyant

[11] Patent Number: 5,222,825

[45] Date of Patent: Jun. 29, 1993

[54] ROUND BACK BINDER

[75] Inventor: Jon R. Wyant, Spring Valley, Ohio

[73] Assignee: The Mead Corporation, Dayton, Ohio

[21] Appl. No.: 853,578

[22] Filed: Mar. 18, 1992

[51] Int. Cl.[5] ..... B42F 13/00

[52] U.S. Cl. ..... 402/76; 281/29; 402/502; 402/73

[58] Field of Search ..... 251/29; 402/73, 74, 402/75, 76, 77, 502; 412/3, 17

[56] References Cited

U.S. PATENT DOCUMENTS

| | | | |
|---|---|---|---|
| 123,947 | 2/1872 | Smith | 281/29 |
| 2,772,427 | 12/1956 | Rankin | 281/29 X |
| 3,145,033 | 8/1964 | Caddov | 281/29 |
| 3,195,924 | 7/1965 | Carter et al. | 281/29 |
| 3,228,709 | 1/1966 | Tooker | 281/29 X |
| 3,318,618 | 5/1967 | Mullen et al. | 281/29 X |
| 3,572,957 | 3/1971 | Strassberg | 402/75 |
| 4,405,156 | 9/1983 | Carter et al. | 281/29 |
| 4,856,817 | 8/1989 | Moor | 281/29 |

*Primary Examiner*—Paul A. Bell
*Attorney, Agent, or Firm*—Biebel & French

[57] ABSTRACT

A binder having a rectangular stiffener board and a sheet retaining assembly. The stiffener board is provided in its first surface with at least three spaced parallel channels medially located between the side edges of the board. Each channel defines a hinge line extending along the height of the stiffener board. The sheet retaining assembly is mounted on the first surface of the board adjacent to the channels but outside the medial section of the board where the channels are located. The binder thus structured allows the stiffener board to define front and rear cover of the binder interconnected by the medial section which is foldable conformingly about the retaining assembly.

21 Claims, 4 Drawing Sheets

ROUND BACK BINDER

BACKGROUND OF THE INVENTION

The present invention relates to a binder having a pair of covers foldably interconnected by a spine to receive a plurality of sheets between the covers and more particularly to a loose-leaf binder whose spine is foldable conformingly about a sheet retaining assembly mounted on one of the covers.

FIG. 1 illustrates a typical prior art binder 90 wherein front and rear covers 96 and 94 are interconnected by a spine 98. A pair of hinge lines 91 and 93 join the spine 98 to the covers 94 and 96, respectively. A snap ring assembly 92 is riveted or otherwise fastened directly to the rear cover 94. The spine panel 98 is free to pivot away from the ring assembly 92 in the direction indicated by the arrow 97 to provide convenient access to the assembly 92. The width of the spine 98 is great enough to enable the covers 96 and 94 to clear the snap rings. This type of binder is particularly well-suited to uses requiring oversized snap rings for maintaining a great number of loose-leaf sheets. Such a binder, however, requires excessive shelf space, and it is difficult to grasp at the wide, flat and pivotable spine 98.

It is therefore seen that there is a need to provide an improved binder. Such a binder should reduce shelf space requirements, and fit in the hands of the user when gripped at the spine.

SUMMARY OF THE INVENTION

This invention provides an improved loose-leaf binder having a rounded spine defined by a plurality of foldably joined spine segments. The spine segments are relatively rigid for structural integrity and sufficiently narrow in lateral extent to enable the spine to fold conformably about a sheet retaining assembly mounted on a cover adjacent to the spine.

According to the present invention, the binder employs a rectangular stiffener board which is preferably formed of laminated paperboard. One surface of the stiffener board is provided with three or more spaced parallel channels medially positioned between the opposite side edges of the stiffener board. Each channel defines a hinge line extending parallel to the side edges of the stiffener board. Stated differently, the hinge lines extend along the height of the stiffener board. A sheet retaining assembly is mounted on the same surface of the stiffener board as the channels, adjacent to but outside the medial spine section of the stiffener board. As a result, the stiffener board defines front and rear covers of the binder interconnected by the medial spine section which is foldable conformingly around the retaining assembly. The portions of the stiffener board between the channels serve respectively as the spine segments mentioned above.

In a preferred embodiment of the present invention, the channels extend entirely along the height of the stiffener board. This arrangement facilitates folding of the spine section.

Further in the preferred embodiment, the retaining assembly has a plurality of snap rings coaxially disposed at intervals along the height of the stiffener board. In this embodiment, the width of each spine segment is less than the outer diameter of the snap rings so that the spine section is foldable conformingly around the snap rings.

The stiffener board may be covered by a pair of surface sheets, preferably fabricated from canvas material. One of the surface sheets, the interior surface sheet, is secured to the channeled surface of the stiffener board by adhesive material. The adhesive may be distributed so as to cause the interior surface sheet to extend conformingly into the channels. This interior surface sheet faces inwardly in the assembled binder. A second sheet, the exterior surface sheet, preferably also canvas, is secured to the opposite surface of the stiffener and faces outwardly in the assembled binder.

The present invention also provides a binder whose spine comprises a backing sheet and a plurality of spaced parallel stiffening strips attached to the backing sheet. Any two adjacent strips are spaced apart by a channel which is defined therebetween, and the channel extends the full height of the spine.

Accordingly, it is an object of the present invention to provide a binder whose spine is foldable conformingly around a sheet retaining assembly of the binder.

Another object of the present invention is to provide a binder which can fit in users' hands when grasped at its spine.

A further object of the present invention is to provide a binder having a spine of reduced profile.

Other objects and advantages of the invention will be apparent from the following descriptions, the accompanying drawings and the appended claims.

DETAILED DESCRIPTION OF THE INVENTION

Figure 1:
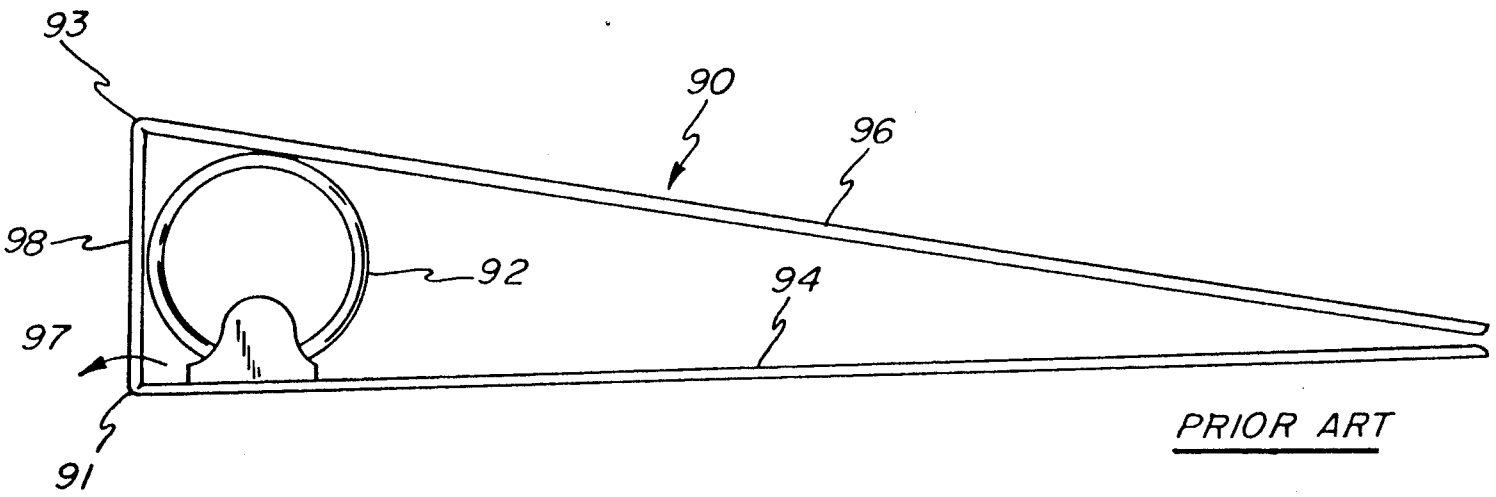
FIG. 1 is an end elevation view of a prior art binder.
Figure 2:
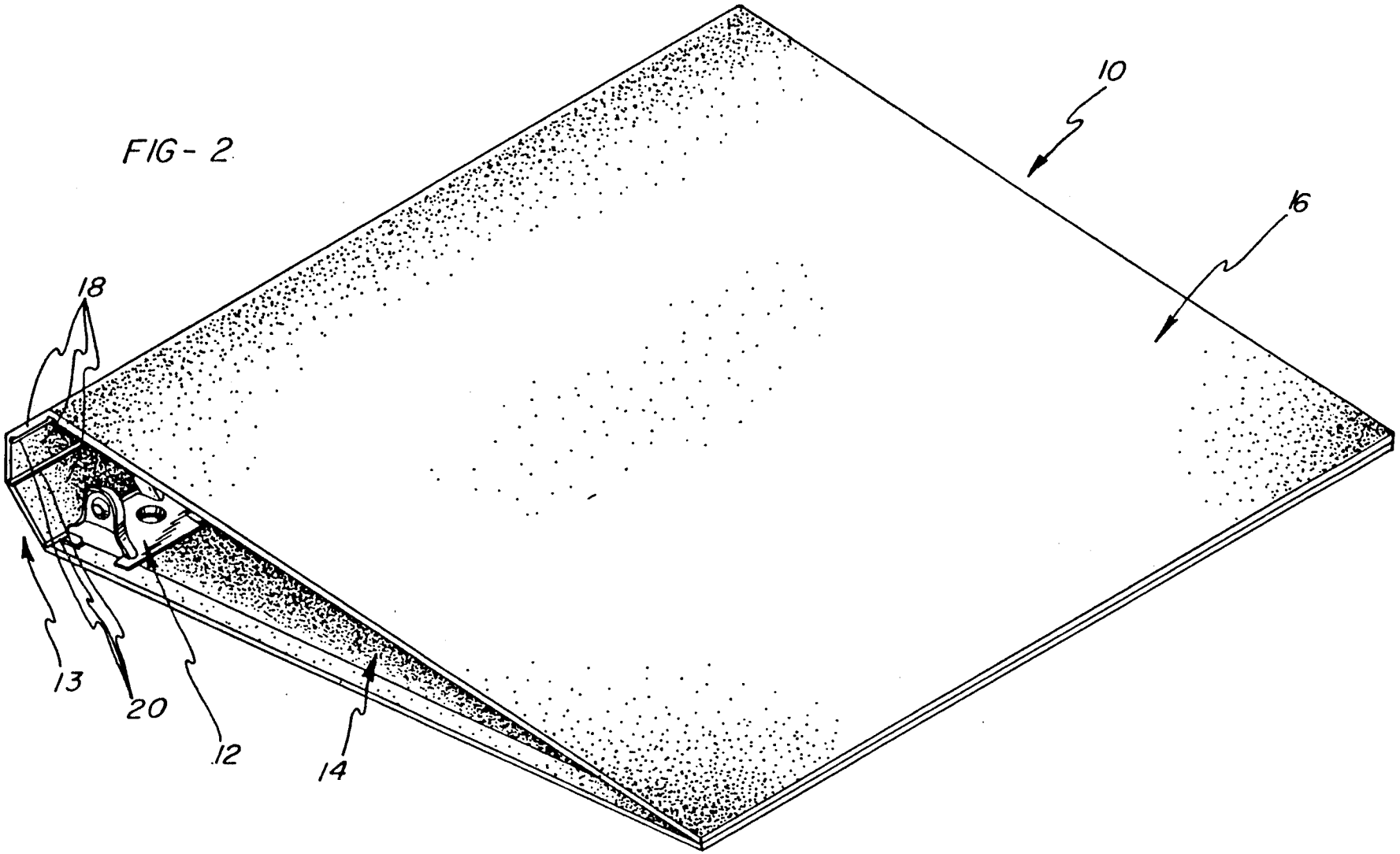
FIG. 2 is a perspective view of a binder according to the present invention.

A binder in accordance with the present invention may appear in FIGS. 2–7 as generally indicated by reference numeral 10. In FIG. 2, the binder 10 includes a front cover 16, a rear cover 14 and a rounded spine 13. The front and rear covers 16 and 14 are foldably joined respectively to the opposite side edges of the spine 13. A series of hinge lines 20 partition the spine 13 into a plurality of narrow spine segments 18. A sheet retaining assembly 12 is secured to the rear cover 14.

The binder 10 shown in FIG. 2 is constituted by two principal structural elements, i.e., a stiffener 11 and the above-mentioned sheet retaining assembly 12.

Figure 3:
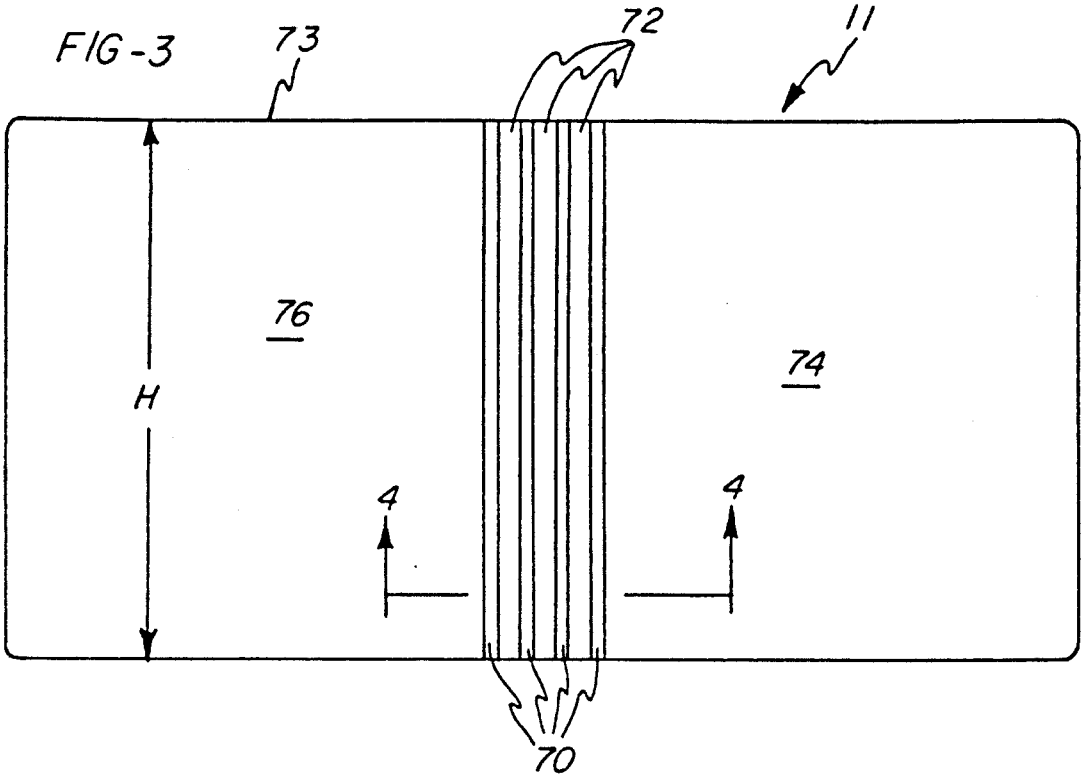
FIG. 3 is a plan view of a stiffener used in the binder in FIG. 2.
Figure 4:
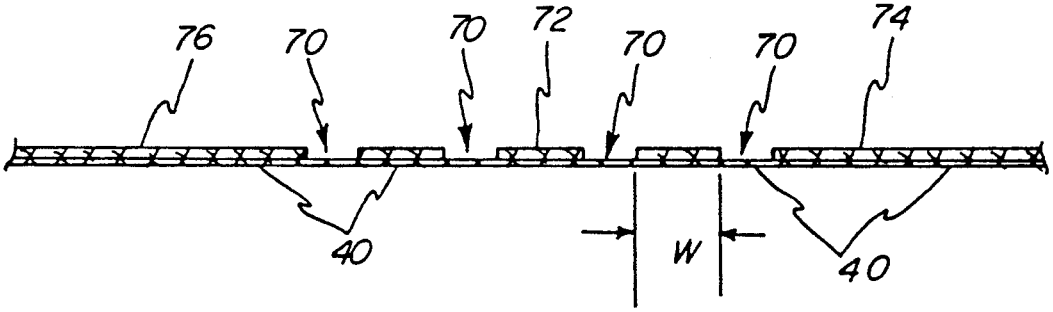
FIG. 4 is a view taken along the line 4—4 in FIG. 3.

The stiffener 11 is generally rectangular in shape as best shown in FIGS. 3 and 4. The stiffener 11 comprises a backing sheet 40, a pair of front and rear leaf panels 76 and 74, and three spaced parallel narrow stiffening strips 72. The leaf panels 76 and 74 are laminated side-by-side on a surface of the backing sheet 40 with a space between them. The stiffening strips 72 are laminated on the surface of the backing sheet 40 between the front and rear leaf panels in such a manner that the strips 72 extend along the height (H) of the stiffener 11. The strips 72 are kept in a spaced parallel relation since they are secured to the backing sheet 40. Channels 70 are defined between the stiffening strips 72 and between the stiffening strips and the leaf panels. The channels 70 preferably extend the full height (H) of stiffener 11.

The stiffener 11 described above defines the front and rear covers 16 and 14 and the spine 13 shown in FIG. 2. More particularly, the front cover 16 is defined by the front leaf panel 76 and the portion of the backing sheet 40 underlying the panel 76 while the rear cover 14 is defined by the rear leaf panel 74 and the portion of the backing panel 40 underlying the rear panel 74. The spine segments 18 are defined by the strips 72 and the portions of the backing sheet 40 underlying the strips 72. The hinge lines 20 are defined by the channels 70.

Figure 5:
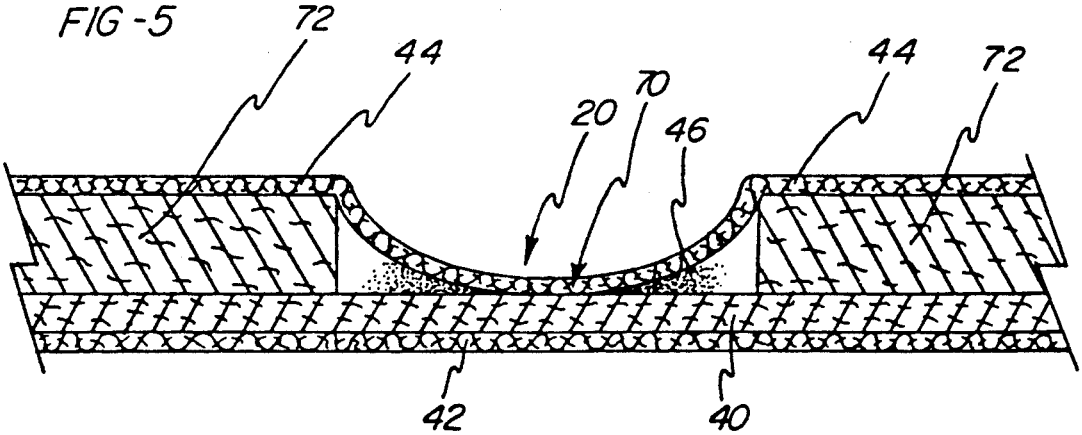
FIG. 5 is an enlarged cross-sectional view of a hinge portion of the binder in FIG. 2.

Alternatively, the stiffener 11 may be covered by surface sheets 44 and 42 as shown in FIG. 5 in order to define the front and rear covers 16 and 14 and the spine 13. The surface sheets 44 and 42 preferably are of canvas material. The surface sheets 44 and 42 are secured respectively to the opposite surfaces of the stiffener 11 by an appropriate adhesive. Such an adhesive may be distributed to include a layer 46 which bonds the interior sheet 44 conformingly into the channels 70.

The stiffener is preferably formed of laminated paperboard. For instance, the front and rear leaf panels 76 and 74 and the stiffening strips 72 comprise die-cut sheets of 110 pt. chipboard for structural rigidity while the backing sheet 40 comprises a flexible, somewhat thinner, chipboard sheet, a thickness of about 24 pt.

It will be readily apparent that although three strips 72 are shown in the drawings, any number more than one strip may be employed in the binder. It will also be apparent that the stiffener 11 may be constructed from a single paperboard sheet; a single paper board sheet may be routed by an appropriate router to define the stiffener 11.

Figure 6:
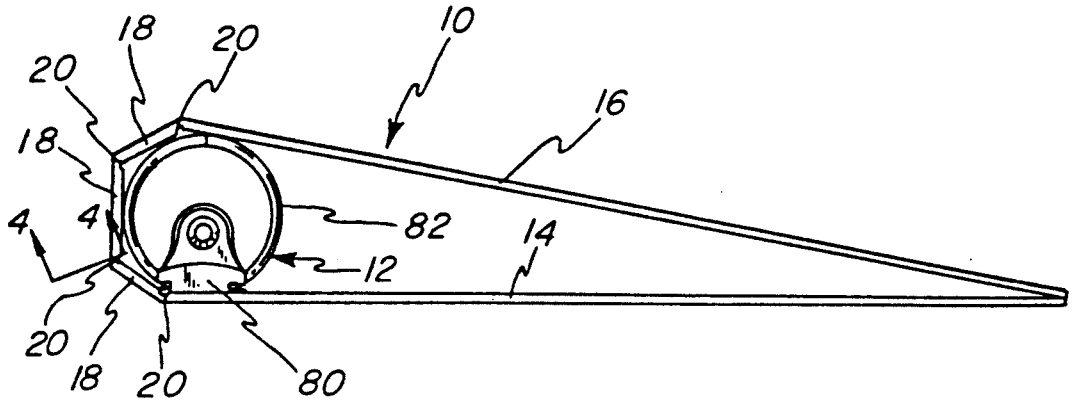
FIG. 6 is an end elevation view of the binder in FIG. 2.
Figure 7:
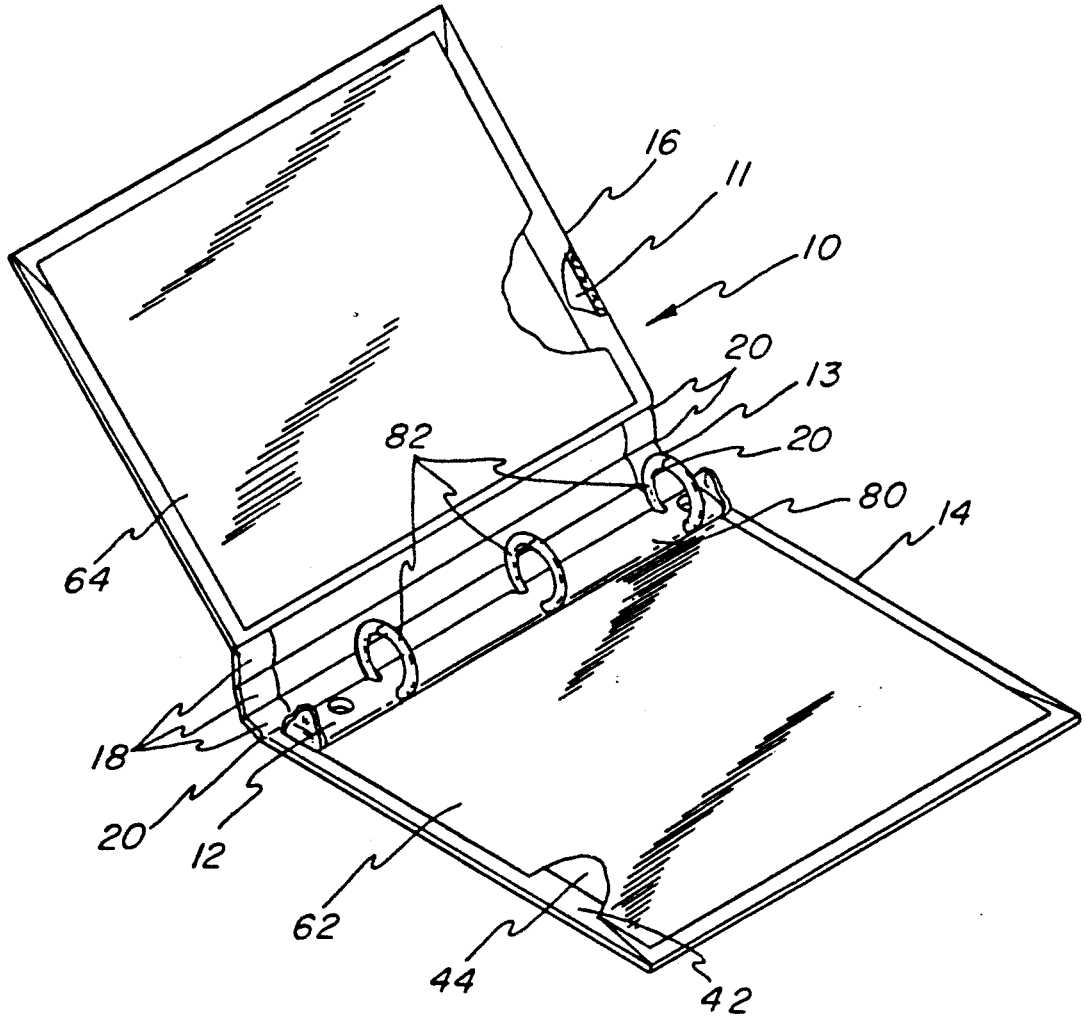
FIG. 7 is a partially cross-sectioned perspective view of the binder in an opened condition.

As best illustrated in FIGS. 6 and 7, the sheet retaining assembly 12 is a conventional snap ring assembly having an elongate base member 80 and a plurality of snap rings 82 carried on the base member 80. The ring assembly 12 is secured to the interior surface of the covered or uncovered stiffener 11 such that the rings 82 are disposed at intervals along the hinge lines 20 and that the base member 80 is mounted outside the medial spine section 13. The diameter of the snap rings 82 is an important factor in designing the binder of the present invention as will be described herein below.

The width (W) of the aforementioned stiffening strips 72, i.e., the distance between any two adjacent channels 70, is less than the outer diameter of the snap rings 82, and is preferably less than a half of or more preferably less than one third of the outer diameter of the snap rings. The smaller the width of the strips 72 is, the more desired curvature for conformity around the snap rings 82 the spine 13 can provide. However, decrease in width of the strips results in increase in manufacturing costs. A preferred width of the strips which can optimize the curvature while minimizing manufacturing costs may be about one third of the outer diameter of the snap rings. The spine 13 having strips of this optimal width and folded conformingly around the snap rings 82 is illustrated in FIG. 6.

Any other conventional sheet retaining means may be used according to the present invention. Such retaining means includes a slidable assembly of the type disclosed in U.S. Pat. No. 3,833,308 to Seaborn.

Additional construction details of the binder 10 are illustrated in FIG. 7. As shown therein, the interior surface sheet 44 substantially covers only the interiorly-facing surface of the stiffener 11. Exterior surface sheet 42 covers the exteriorly-facing surface of the stiffener 11, extends around the edges thereof and is bonded against the interior surface of the interior surface sheet 44. The rear cover 14 and the front cover 16 may be finished off, as desired, by a pair of paper finishing sheets 62 and 64, respectively. The sheets 62 and 64 may be die-cut sheets of 6 pt. stock.

While the form of apparatus herein described constitutes a preferred embodiment of this invention, it is to be understood that the invention is not limited to this precise form of apparatus, and that change may be made therein without departing from the scope of the invention which is defined in the appended claims.

What is claimed is:

1. A binder comprising:

a generally rectangular paperboard stiffener comprising a pair of leaf panels separated by and joined to a medially positioned spine section and having an interior surface provided with a plurality of parallel and partially penetrating channels extending along said spine section for the full height thereof to define at least three flexible hinge lines and an oppositely disposed exterior surface;

an interior surface sheet secured to the interior surface of said stiffener;

an exterior surface sheet secured to the exterior surface of said stiffener; and sheet retaining means mounted on said interior surface sheet and secured to said stiffener adjacent and parallel to said hinge lines;

whereby said surface sheets and said stiffener cooperatively define front and rear covers foldably interconnected by a segmented spine which hinges conformingly about said sheet retaining means to enable closure of said binder.

2. A binder according to claim 1 wherein said surface sheets are of canvas material.

3. A binder according to claim 1 wherein said interior surface sheet is adhesively bonded into said channels.

4. A binder according to claim 1 wherein said exterior surface sheet extends around the perimeter of said stiffener and is bonded overlappingly on top of said interior surface sheet.

5. A binder according to claim 4 further comprising a pair of finishing sheets bonded to said front and rear covers on top of said interior surface sheet.

6. A binder according to claim 5 wherein said surface sheet and said stiffener defines three foldably joined spine segments.

7. A binder according to claim 6 wherein said sheet retaining means comprises a snap ring assembly.

8. In a binder comprising a rear cover, a spine foldably joined to said rear cover, a front cover foldably joined to said spine opposite said rear cover and sheet retaining means secured to said rear cover parallel and adjacent said spine, the improvement wherein said spine comprises:

a flexible backing means, a plurality of relatively stiff medial strips bonded to said backing means and extending substantially the full height of said binder, said medial strips extending in spaced parallel relation and cooperating with said backing means to define parallel surface channels between said medial strips, interior surface sheet means bonded to said medial strips and extending conformingly into said channels, exterior surface sheet means bonded to said backing sheet opposite said interior surface sheet;

said spine being foldable along said channels for conformance about said sheet retaining means.

9. The improvement of claim 8 wherein said relatively stiff medial strips are adhesively bonded to said flexible backing means.

10. A binder comprising:

a generally rectangular stiffener board having upper and lower edges and a pair of side edges, one of the surfaces of said stiffener board being provided with at least three spaced parallel and partially penetrating channels medially located between said side edges, each of said channels defining a hinge line extending the full height of said stiffener board;

surface sheet means covering said stiffener board so that said surface sheet means and said stiffener board cooperatively define a segmented spine in the region of said channels, a front cover joined to said spine and extending therefrom to one of said side edges, and a rear cover joined to said spine opposite said front cover and extending to the other one of said side edges; and sheet retaining means for releasably holding sheets to be bound by said binder, said retaining means being mounted on said rear cover adjacent said segmented spine, so that said segmented spine and said front cover fold conformingly around said retaining means.

11. A binder according to claim 10 wherein said retaining means comprises a plurality of snap rings of common diameter which are coaxially disposed at intervals along the height of said stiffener board, and further wherein the distance between any two adjacent ones of said channels is less than said common diameter so that said segmented spine and said front cover are foldable conformingly thereabout.

12. A binder according to claim 11 wherein the distance between any two adjacent ones of said channels is less than a half of said common diameter.

13. A binder according to claim 12 wherein the distance between any two adjacent ones of said channels is less than one third of said common diameter.

14. A binder according to claim 10 wherein the distances between adjacent ones of said channels are equal.

15. A binder according to claim 14 wherein said surface sheet means are adhesively bonded into said channels.

16. A binder according to claim 14 wherein said surface sheet means are of canvas material.

17. A binder according to claim 14 wherein said surface sheet means comprise an exterior surface sheet exteriorly covering said stiffener board and an interior surface sheet interiorly covering said stiffener board; said exterior surface sheet extending around the perimeter of said stiffener board and being bonded overlappingly against said interior surface sheet.

18. A binder according to claim 17 further comprising a pair of finishing sheets attached interiorly to said front and rear covers for covering said interior surface sheet.

19. A binder according to claim 10 wherein said stiffener board comprises paperboard.

20. A binder according to claim 10 wherein said stiffener board comprises first and second panels fixedly disposed on a surface of a backing sheet in a side-by-side spaced relation, and a plurality of spaced parallel stiffening strips attached to said surface of said backing sheet between said first and second panels such that said channels are defined in said stiffener board between said first and second panels.

21. A binder according to claim 10 wherein said retaining means comprises a base member mounted on said stiffener board and extending along the height of the stiffener board, and engaging means carried by said base member for direct engagement with sheets; the distance between any two adjacent ones of said channels being less than the width of said base member.

* * * * *